United States Patent [19]

Glover

[11] Patent Number: 4,464,883

[45] Date of Patent: Aug. 14, 1984

[54] WRAPPING MACHINES

[75] Inventor: William Glover, West Denton, England

[73] Assignee: Baker Perkins Holdings Limited, Peterborough, England

[21] Appl. No.: 327,451

[22] Filed: Dec. 4, 1981

[30] Foreign Application Priority Data

Dec. 11, 1980 [GB] United Kingdom ..... 8039691

[51] Int. Cl.[3] ..... B65B 9/10; B65B 11/10

[52] U.S. Cl. ..... 53/550

[58] Field of Search ..... 53/550, 553, 555, 450, 53/433, 511

[56] References Cited

U.S. PATENT DOCUMENTS 2,747,346 5/1956 Tigerman et al. ..... 53/550 X 3,090,174 5/1963 Kraft ..... 53/511 X 3,417,544 12/1968 Grevich ..... 53/550

3,431,831 3/1969 McGill et al. ..... 53/550 X 4,035,984 7/1977 Gerlach et al. ..... 53/550 X

*Primary Examiner*—Horace M. Culver

*Attorney, Agent, or Firm*—Watson, Cole, Grindle & Watson

[57] ABSTRACT

A wrapping material of the horizontal form, fill and seal type has, positioned between a horizontal tube former which forms a web of wrapping material into a tube with a longitudinal bottom joint and an infeed conveyor which advances articles to be wrapped at regular intervals towards the tube former, a platform on which the articles are temporarily supported until pushed off it into the tube former by succeeding articles delivered by the infeed conveyor.

5 Claims, 5 Drawing Figures

WRAPPING MACHINES

BACKGROUND OF THE INVENTION

1. Field of the Invention

This invention relates generally to wrapping machines of the horizontal form, fill and seal type and more particularly to a machine including a horizontal tube former which forms a web of wrapping material into a tube having a longitudinal bottom joint, a mechanism which engages the joint to advance the tube continuously forward, an infeed conveyor having pushers which advance articles to be wrapped at regular spacing towards the tube former and crimping dies disposed beyond the tube former for forming transverse seals in the tube beyond the articles. The crimping dies normally also sever the tube at the seals into individual packages.

The tube former has upstanding side walls and a flat base having a V-shaped slot through which the edges of the web of wrapping material pass downwardly to be brought together to form the longitudinal bottom joint.

2. Description of the Prior Art

It has hitherto been necessary when wrapping batched products to provide an overhead paddle conveyor to propel loose goods forward, the paddles acting through the wrapping material on the goods, until they reach the crimping dies. This overhead conveyor adds to the cost of the machine, reduces access to the tube former and disturbs the wrapping material during formation of the tube. This is particularly disadvantageous when the articles are constituted by batches of biscuits, pieces of toasted bread or the like standing on edge with the lengthwise dimension of the batch in line with the direction of travel because it prevents tight wrapping of the batches.

SUMMARY OF THE INVENTION

With a view to eliminating the necessity for an overhead conveyor, the invention provides a wrapping machine having a horizontal tube former which forms a web of wrapping material into a tube having a longitudinal bottom joint, a mechanism which engages the joint to advance the tube continuously forward, an infeed conveyor having pushers which advance articles to be wrapped at regular spacing towards the tube former, and a stationary platform disposed between the delivery end of the infeed conveyor and the tube former. The platform is disposed at a slightly higher level than the base of the tube former and serves temporarily to support articles advanced onto it by the infeed conveyor until they are pushed off it into the tube former by succeeding articles delivered to the platform by the infeed conveyor.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figure 1:
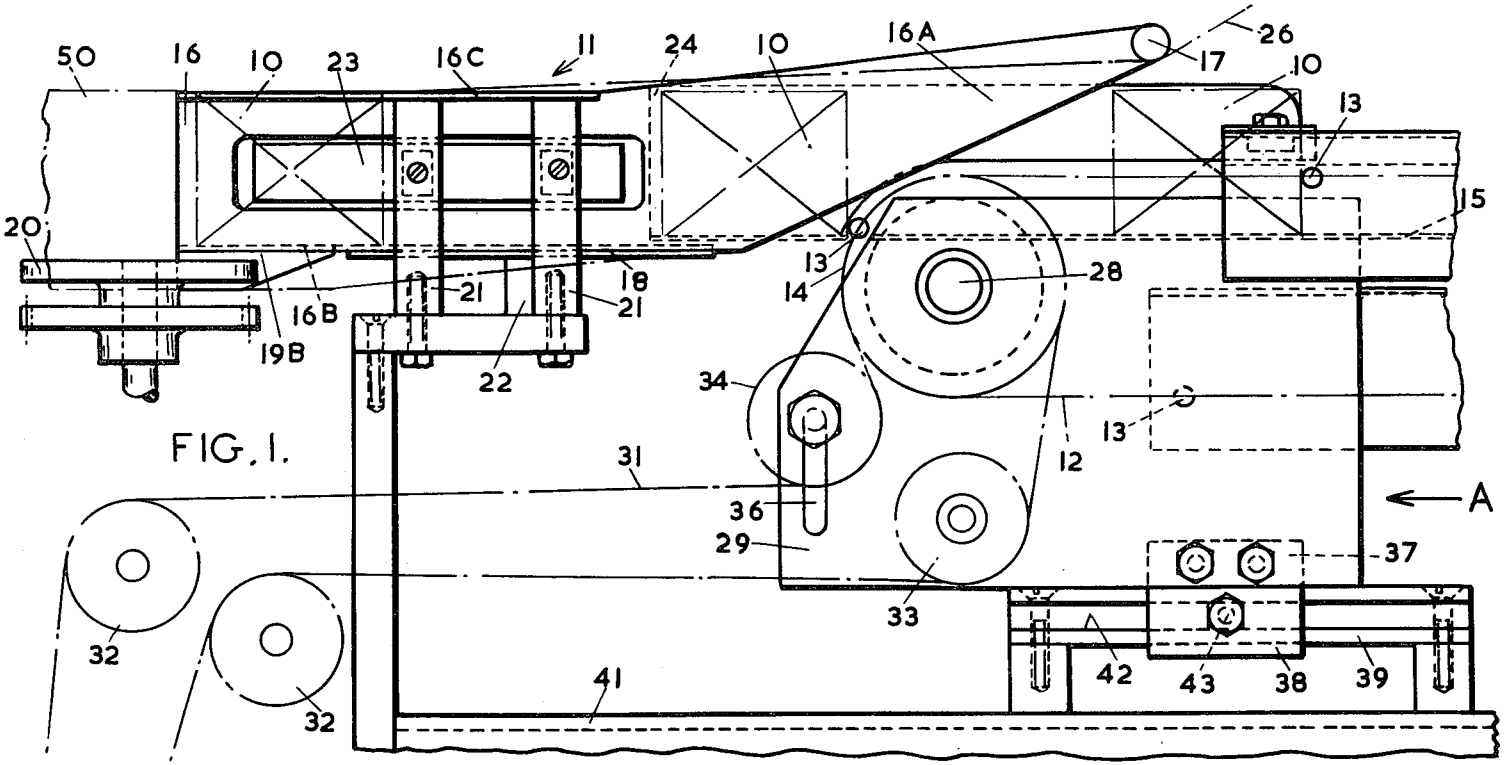
FIG. 1 is a side elevation showing the tube former and a portion of the infeed conveyor.
Figure 2:
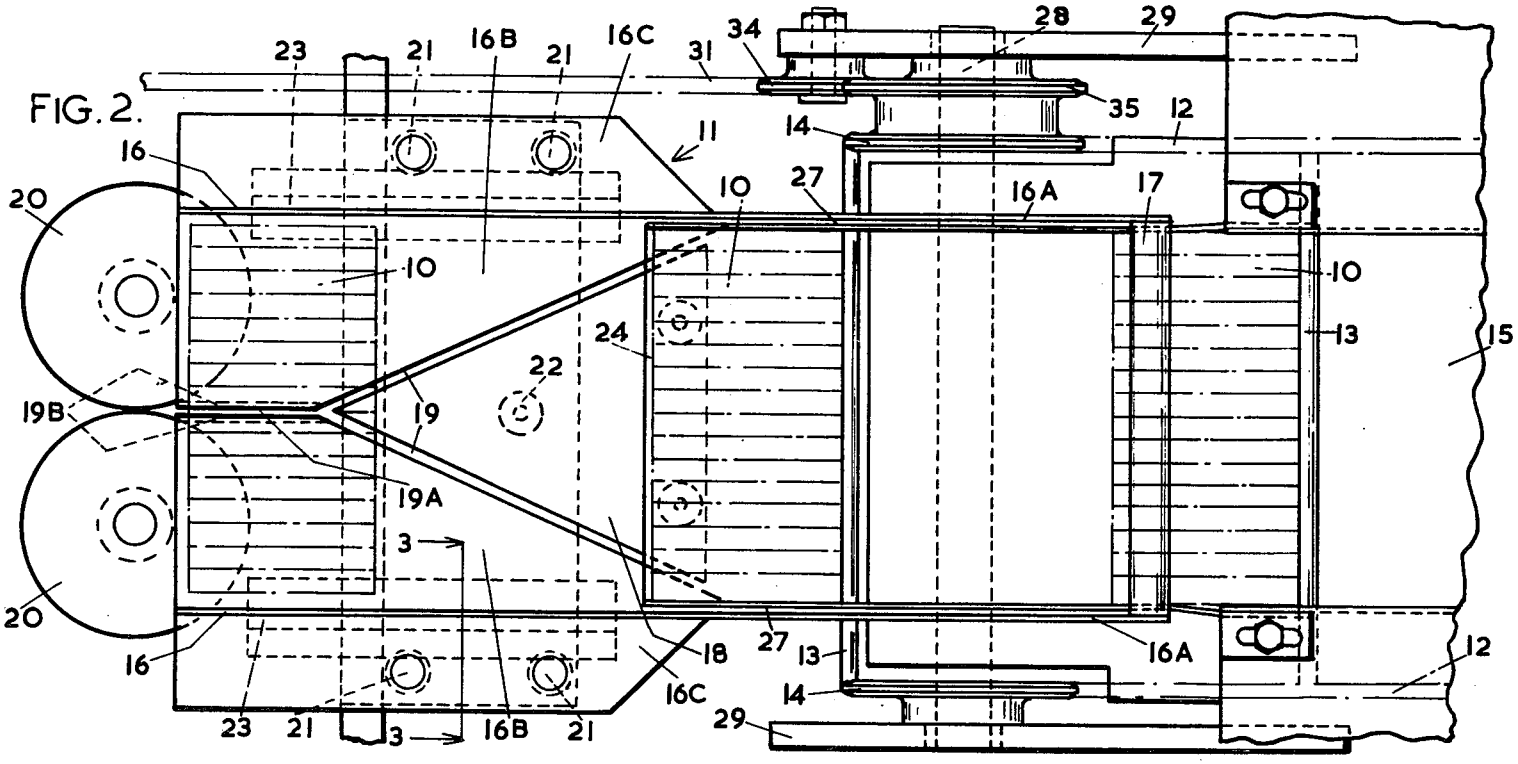
FIG. 2 is a corresponding plan view.
Figure 4:
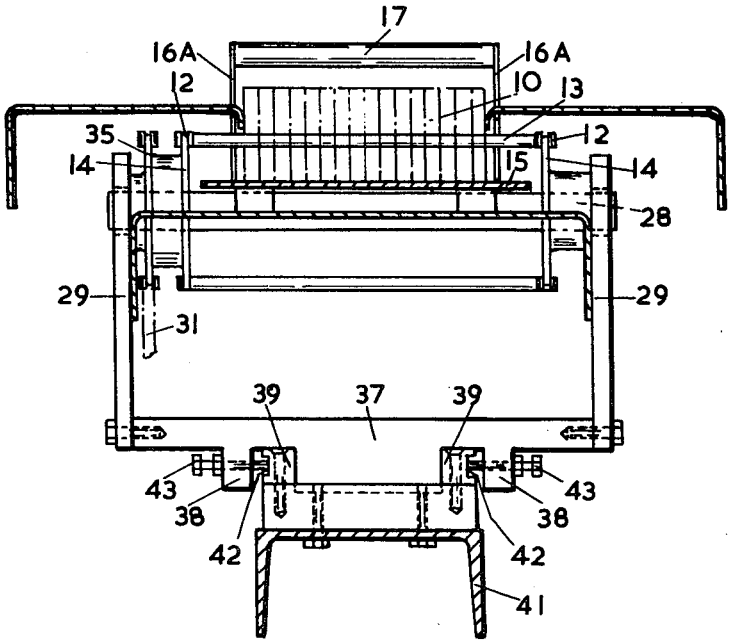
FIG. 4 is an end view looking in the direction of the arrow A in FIG. 1.

As shown in the drawings, batches 10 of biscuits are advanced to a horizontal tube former 11 by an infeed conveyor, which includes regularly spaced pusher bars 13 which span a pair of chains 12 running over end sprockets 14, the advancing batches being supported on a dead plate 15.

Figure 3:
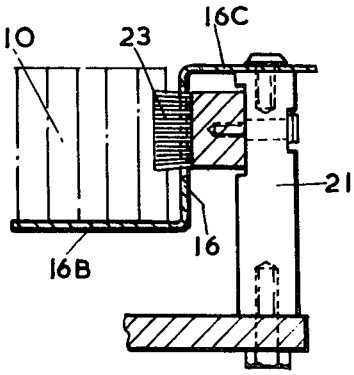
FIG. 3 is a section on the line 3—3 in FIG. 2.

The tube former 11 consists of a pair of upstanding side members 16 having wings 16A, which extend towards the infeed conveyor and are joined by a rod 17, and outturned top flanges 16C. The tube former has a flat horizontal base, constituted by inturned portions 16B of the side members 16 and a triangular portion 18 which are separated by a forwardly converging V-shaped slot 19 and an adjoining longitudinal slot 19A formed between downturned flanges 19B on the portions 16B. The flanges 16C of the side members 16 are mounted on supporting pillars 21 which extend upwardly from the machine frame as shown in FIG. 3 and the triangular portion 18 is mounted on the machine frame by a central support 22.

Between the base of the tube former 11 and the dead plate 15 is a U-shaped platform 24, which is disposed at the same level as the dead plate with its base spaced 2 mm above the base of the tube former to allow the wrapping material to pass beneath it.

Figure 5:
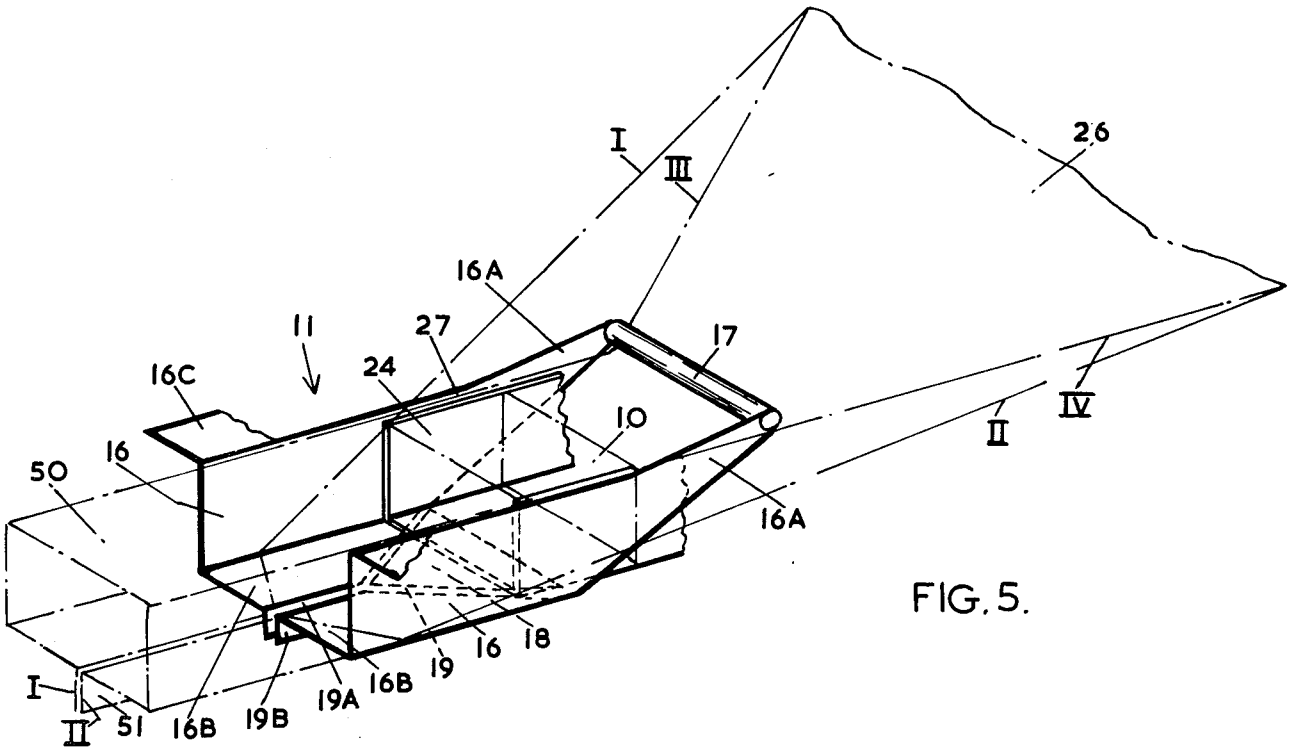
FIG. 5 is a perspective view on a larger scale showing the tube former and a portion of the platform.

A web 26 of wrapping material is drawn continuously towards the tube former by the traction of a pair of traction rollers 20. As shown in FIG. 5, the web 26 passes beneath the rod 17 and its central portion drapes over the top and sides of an advancing batch 10 of biscuits while its edge portions are drawn down through gaps 27 between the wings 16A and the platform 24 and then through the V slots 19, which initially folds these portions against the base of the article. The edges of the web are finally brought together in the slot 19A to form fins which are engaged by the rollers 20. The web is thus formed continuously into a tube 50 having a bottom fin seal 51. The entubing action is assisted by brushes 23 which extend inwardly from the side members 16. During the formation of the tube the edge portions of the web move inwardly between the base of the platform 24 and the base of the tube former 11 prior to passage into the slot 19 as shown in FIG. 1. As will be seen from FIG. 5 the width of the web 26 exceeds the length of the rod 17 and in FIG. 5 the edges of the web are marked I and II and folds formed in the web as it passes under the rod 17 are marked III and IV.

The pusher bars 13 push the batches 10 of biscuits in succession onto the platform 24, where each batch dwells until it is pushed off by arrival of the next batch onto the base of the tube former 11 along which it is advanced by the traction of the tube of wrapping material. When the batch has arrived there the entubing action of the wrapper and the tightness of wrap achieved by the brushes 23 and the bottom sealing at the fin seal 51 ensure that the batch will be carried forward at the same speed as the wrapping material towards crimping and severing dies, not shown, which form transverse seals in the tube 50 between the batches 10 and sever the tube 50 into individual packages in the conventional manner.

The sprockets 14 are secured to a shaft 28, rotatably mounted in side plates 29 and driven from a shaft (not shown) by a chain 31 passing over sprockets 32, 33, 34 and 35. The sprockets 32 are secured to the framework of the machine, the sprocket 33 is secured in one of the side plates 29, the sprocket 34 is adjustably mounted in a slot 36 formed in the side plate 29 and the sprocket 35 is secured to the shaft 28.

The side plates 29 form part of an assembly for adjusting the position of the sprockets 14 in relation to the platform 24. The side plates are secured to a carrier 37 provided with depending lugs 38 and resting on a slideway 39 secured to a framework 41. The slideway 39 is provided with grooves 42 which are engaged by screws 43 mounted in the lugs 38 which serves to lock the assembly in the desired position. Thus, when it is desired to adjust the assembly it is a simple matter to release the screws 43 from contact with the grooves 42, slide the assembly to the required position, and then re-tighten the screws to lock the assembly in position.

When such adjustment is made, the tension in the drive chain 31 is maintained by adjustment of the sprocket 34 in the slot 36. Similarly the tension in the infeed conveyor chains 12 is maintained by an adjustable sprocket (not shown) incorporated in the conveyor 12.

If desired the platform 24 between the infeed conveyor and the tube former 11 may be arranged to hold more than one batch 10 of biscuits prior to successive release of the batches to the tube 50 of wrapping material.

The infeed conveyor may operate continuously or intermittently and the apparatus can be used to wrap individual solid products as well as batches of biscuits or the like.

Obviously, numerous modifications and variations of the present invention are possible in light of the above teachings. It is therefore to be understood that within the scope of the appended claims, the invention may be practiced otherwise than as specifically described herein.

I claim:

1. A wrapping machine for wrapping batches of biscuits and like articles comprising a horizontal tube former which forms a web of wrapping material into a tube having a longitudinal bottom joint, said tube former comprising a flat base having a V-shaped slot which converges in the direction of advance of said web and side walls upstanding from said base, an infeed conveyor having pushers which advance said batches at regular spacing towards said tube former, a stationary platform disposed between a delivery end of said infeed conveyor and said tube former and arranged to receive said batches in succession from said conveyor, said platform having a platform base disposed at a slightly higher level than said base of said tube former, said platform having sides disposed inwardly of said side walls of said tube former and serving temporarily to support batches advanced onto said platform by said infeed conveyor until said batches are pushed off said platform by succeeding batches delivered thereto by said infeed conveyor, means for guiding said web so that a central portion of said web drapes over top and side portions of each advancing batch and edge portions thereof pass downwardly through gaps defined between said side walls of said tube former and said platform, then inwardly between said bases of said platform and said tube former and finally downwardly through said V-shaped slot to form said longitudinal bottom joint, and drive means for engaging said bottom joint to advance the web continuously through the tube former to form a tube, tightly embracing and supporting said batches.

2. A wrapping machine according to claim 1, wherein said forwardly converging V slot in the base of said tube former leads to a central longitudinal slot, from which said longitudinal bottom joint emerges for engagement by said drive means.

3. A wrapping machine according to claim 2, wherein said drive means comprises a pair of traction rollers engaging opposite sides of said bottom joint.

4. A wrapping machine according to claim 2, in which said side walls of said tube former comprise wings extending towards said infeed conveyor and spanned by a rod beneath which said web of wrapping material passes as said web enters said tube former.

5. A wrapping machine as claimed in claim 1, which includes brushes mounted on the side walls of said tube former and extending inwardly therefrom to engage said tube.

* * * * *